US005258143A

United States Patent [19]

Wang

[11] Patent Number: 5,258,143

[45] Date of Patent: Nov. 2, 1993

[54] CARBURETOR WITH A CAM-CONTROLLED VENTURI

[76] Inventor: Ming-Ching Wang, Ist, No. 45, Alley 7, Lane 170, Dung-Hsin Street, Taipei City, Taiwan

[21] Appl. No.: 912,966

[22] Filed: Jul. 10, 1992

[51] Int. Cl.[5] ..... F02M 9/06

[52] U.S. Cl. ..... 261/44.3; 261/121.4; 261/DIG. 19

[58] Field of Search ..... 261/44.3, 121.4, DIG. 19

[56] References Cited

U.S. PATENT DOCUMENTS

| | | | |
|---|---|---|---|
| 3,493,217 | 2/1970 | Farley | 261/121.4 |
| 3,795,237 | 3/1974 | Denton | 261/121.4 |
| 3,829,069 | 8/1974 | Hailstone et al. | 261/44.3 |
| 3,906,910 | 9/1975 | Szlaga, Jr. | 261/121.4 |
| 3,996,904 | 12/1976 | Kobuki et al. | 261/DIG. 19 |
| 4,007,721 | 2/1977 | Regueiro | 261/121.4 |
| 4,053,543 | 10/1977 | Pettitt | 261/121.4 |
| 4,117,810 | 10/1978 | John | 261/44.3 |
| 4,150,070 | 4/1979 | Hashimoto et al. | 261/44.3 |
| 4,168,680 | 9/1979 | Kawai et al. | 261/DIG. 19 |
| 4,545,350 | 10/1985 | Nakamura et al. | 261/DIG. 19 |

*Primary Examiner*—Tim Miles

*Attorney, Agent, or Firm*—W. Wayne Liauh

[57] ABSTRACT

A carburetor with a cam-controlled venturi; the carburetor mainly comprises a front part, a body and a rear part, and the carburetor further comprises a cam-controlled adjustable venturi mechanism, a main choker, a heavy-duty fuel supply system, a vacuum-controlled delay valve, an automatic horsepower-regulating choker and an idle fuel passage system; the object of such a carburetor is to save fuel, to reduce waste gas and to produce a higher driving power.

6 Claims, 6 Drawing Sheets

CARBURETOR WITH A CAM-CONTROLLED VENTURI

BACKGROUND OF THE INVENTION

Generally, the function of a carburetor is to supply a fuel/air mixture in a suitable proportion so as to meet the requirement of an engine under various operation conditions. Usually, a carburetor comprises a venturi; when the air flows through the venturi, the air passes through the throatlike passage will have a higher velocity to produce a vacuum sucking force so as to cause the fuel flow out of the fuel nozzle to be mixed with the air.

A carburetor with an adjustable venturi is capable of saving fuel, but it would cause the engine vacuum force to become lower upon the engine running at a high speed and load or at an ultimate speed because of the venturi being a single fuel passage member. Since the venturi is far away from the fuel outlet, the fuel would be unable to provide a sufficient horsepower; further, the total amount of gas will be limited, and therefore the performance of the engine will be lowered.

The conventional carburetor has employed a multi-fuel passage system; however, since all the venturi tubes are fixed type, they are unable to supply a suitable fuel and air mixture in suitable proportion to meet the requirement of an engine under various speeds, and therefore it is unable to have a complete combustion and to save fuel.

SUMMARY OF THE INVENTION

This invention relates to a carburetor with a cam-controlled venturi, and particularly to a carburetor improvement, in which the venturi is adjusted by means of the curved surface of a cam. The carburetor comprises a front part, a body and a rear part, which further include a cam-controlled adjustable venturi mechanism, a main choker valve and a heavy-duty fuel supply system, a vacuum-controlled delay valve, an automatic horsepower-regulating choker valve and an idle fuel passage system. The primary object of the present invention is to provide a carburetor which can save fuel, exhaust less waste gas and provide a higher driving power.

BRIEF DESCRIPTION OF THE DRAWINGS

FIG. 2-1 is a front view of the vacuum-controlled delay valve mechanism for the adjustable venturi.

FIG. 3-1 is a rear view of the carburetor according to the present invention.

FIG. 3-2 is a sectional view taken along line A—A in FIG. 3-1.

FIG. 4-1 is an enlarged section view of the idle fuel passage system in the carburetor according to the present invention.

FIG. 4-2 is another enlarged section view of the idle fuel passage system in the carburetor according to the present invention.

Referring to FIG. 1, the carburetor according to the present invention comprises a front part 1, a body 2, and a rear part 3; O-ring seals 22 and 27 are mounted between each respective pair of aforesaid major parts. The front part 1 includes a sliding channel 56 with an adjustable venturi 4 therein. The upper part of the venturi 4 is connected with a connecting rod 30 which is mounted with a return spring 54; the spring 54 is retained inside the sliding channel 56 by means of a cap 10. The variable venturi 4 is controlled with a connecting rod 30 to move up and down by means of the curved surface of a cam 8 pivotally mounted on a pivot 9 so as to vary the vacuum condition inside the venturi 4 in accordance with the actual requirement of an engine to suck a suitable amount of gas mixture for complete combustion in order to save fuel. There is a fuel outlet A which is a gap ranging from 0.1 mm to 0.15 mm formed between the front part 1 and the body 2. The fuel for the fuel outlet is supplied with two carbureting tubes 24 in the bottom of the front part 1 being in communication with the float chamber 6. Theoretically, the gap having a space of under 0.15 mm would produce a better atomized fuel for complete combustion.

Figure 1:
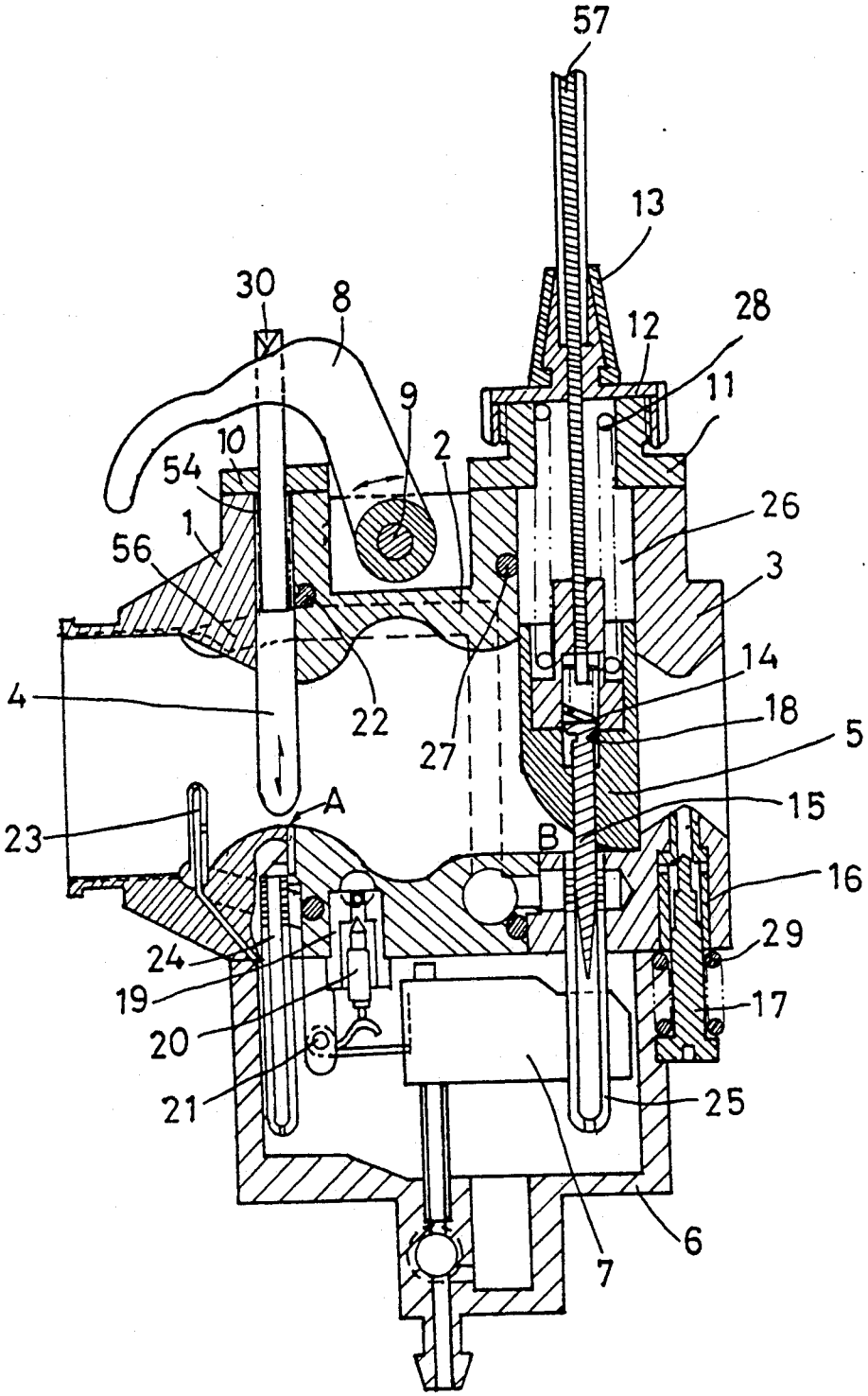
FIG. 1 is a front sectional view of a carburetor according to the present invention.
Figure 5:
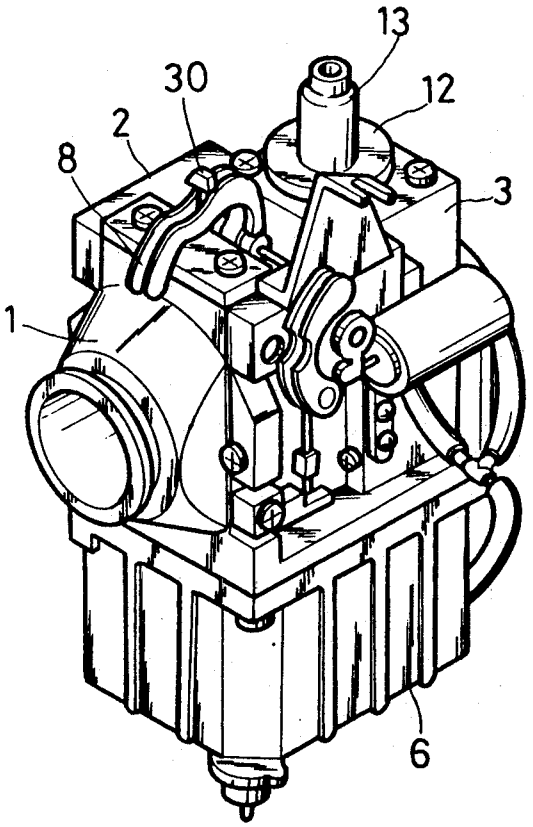
FIG. 5 is a perspective view of the carburetor according to the present invention.

Since the main fuel passage is controlled with the adjustable venturi 4, the engine can be provided with just the right amount of supply of atomized fuel, which can be adjusted on a continuous basis, upon running at a constant speed after an acceleration being made because that the adjustable venturi 4 can have a suitable supply of atomized fuel and fuel-and-air ratio as a result of the curved surface of the cam 8 together with the main choker valve 5 in the rear part 3; in other words, a car can save fuel upon running at a constant speed.

In the present invention, there is another accelerating pump to supply fuel through a tube 23 when a car is accelerated under an emergency condition so as to maintain the car to run smoothly.

The main choker valve and the heavy-duty fuel supply system (as shown in FIG. 1) include a main choker 5, a fuel needle 15, a connecting block 14, a return spring 28 of the fuel needle, a retaining spring 18 of the fuel needle, and a heavy-duty carbureting tube 25. The main choker valve 5 is fixedly mounted on the rear part 3; the fuel needle 15 is mounted in the main choker valve 5, and is retained in place with a retaining spring 18 and a connecting block 14 which is connected with a steel cable 57. The upper end of the connecting block 14 has a spring chamber 26 for receiving a return spring 28 of the fuel needle. The upper end of the return spring 28 is mounted in place with a cap 11, a sleeve cap 12 and a sleeve member 13.

When a heavy horsepower is required for a higher load, the main choker valve 5 will be opened to a given position, and the fuel needle 15 will be pulled upwards with the steel cable 57 and the connecting block 14 to compress the return spring 28; then, the fuel needle will be pulled out of the fuel outlet B; in that case, the heavy-duty carbureting tube 25 will provide a given amount of atomized fuel. The sharpness of the fuel needle 15 is designed in accordance with the requirement of an engine. When the atomized fuel out of the main fuel passage of the adjustable venturi 4 reaches a limit, the auxiliary carbureting tube under the main choker 5 is opened to provide a sufficient fuel to satisfy the engine need in order to have a higher horsepower output.

Figure 2:
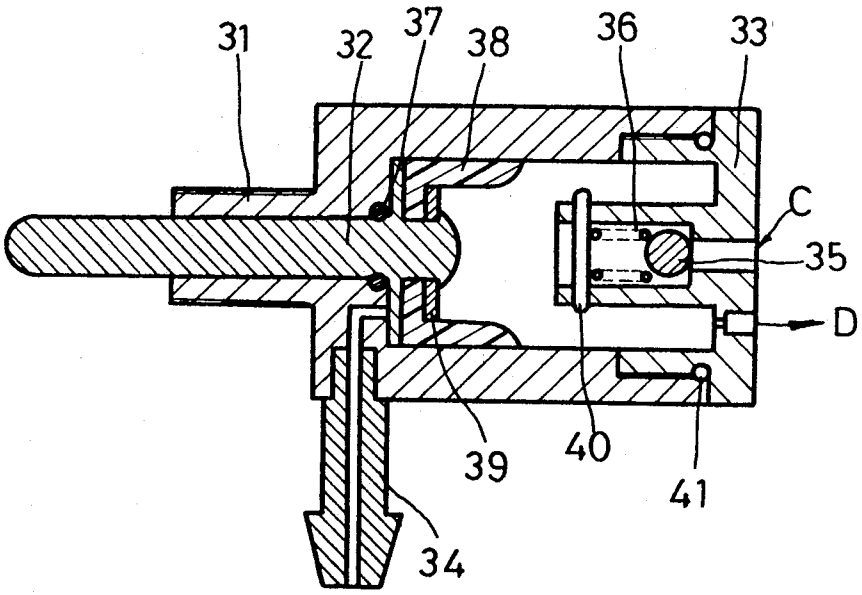
FIG. 2 is a sectional view of a vacuum-controlled delay valve in the carburetor of the present invention.
Figures 1, 2:
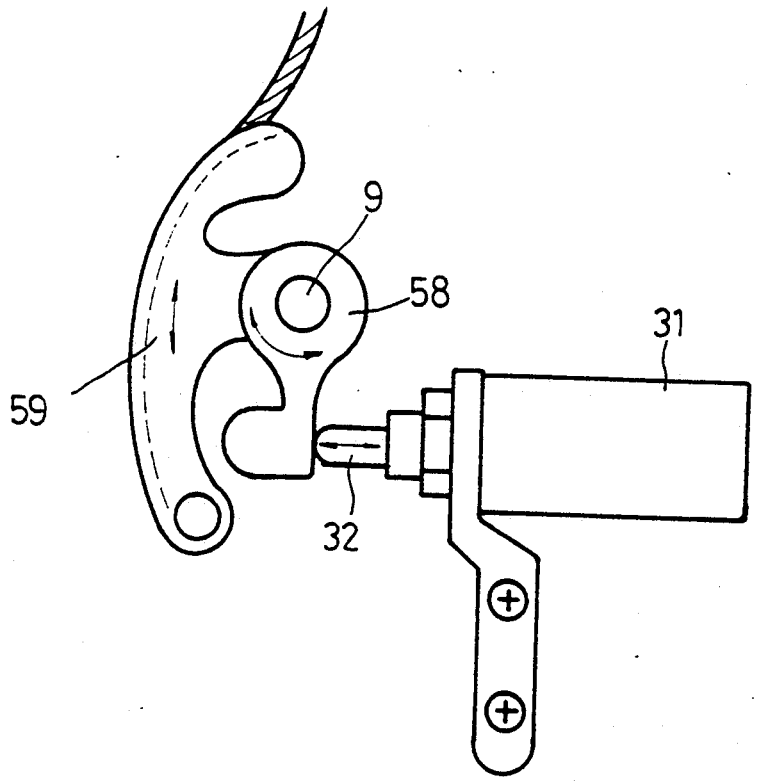
Figures 1, 3:
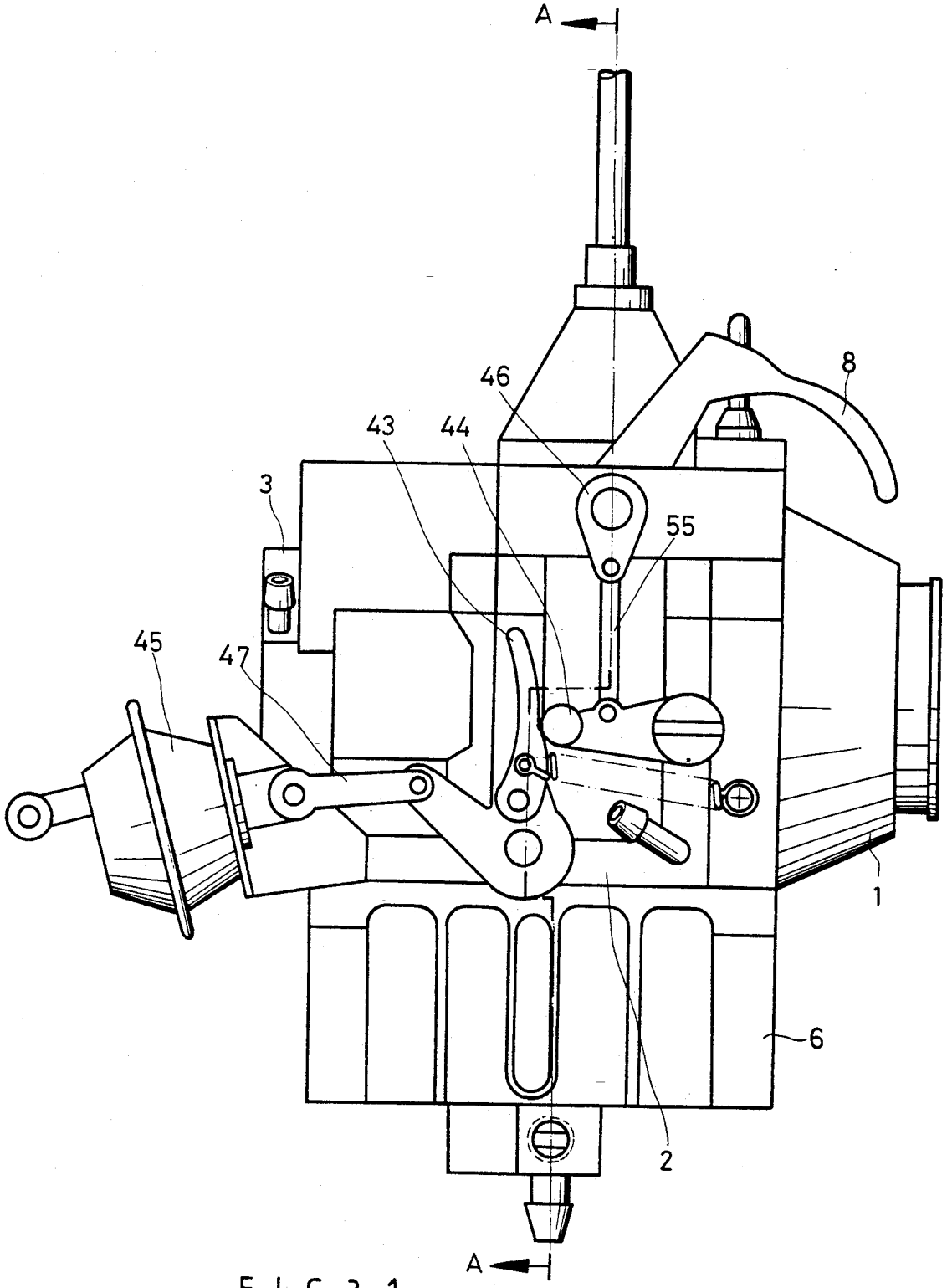
Figures 2, 3:
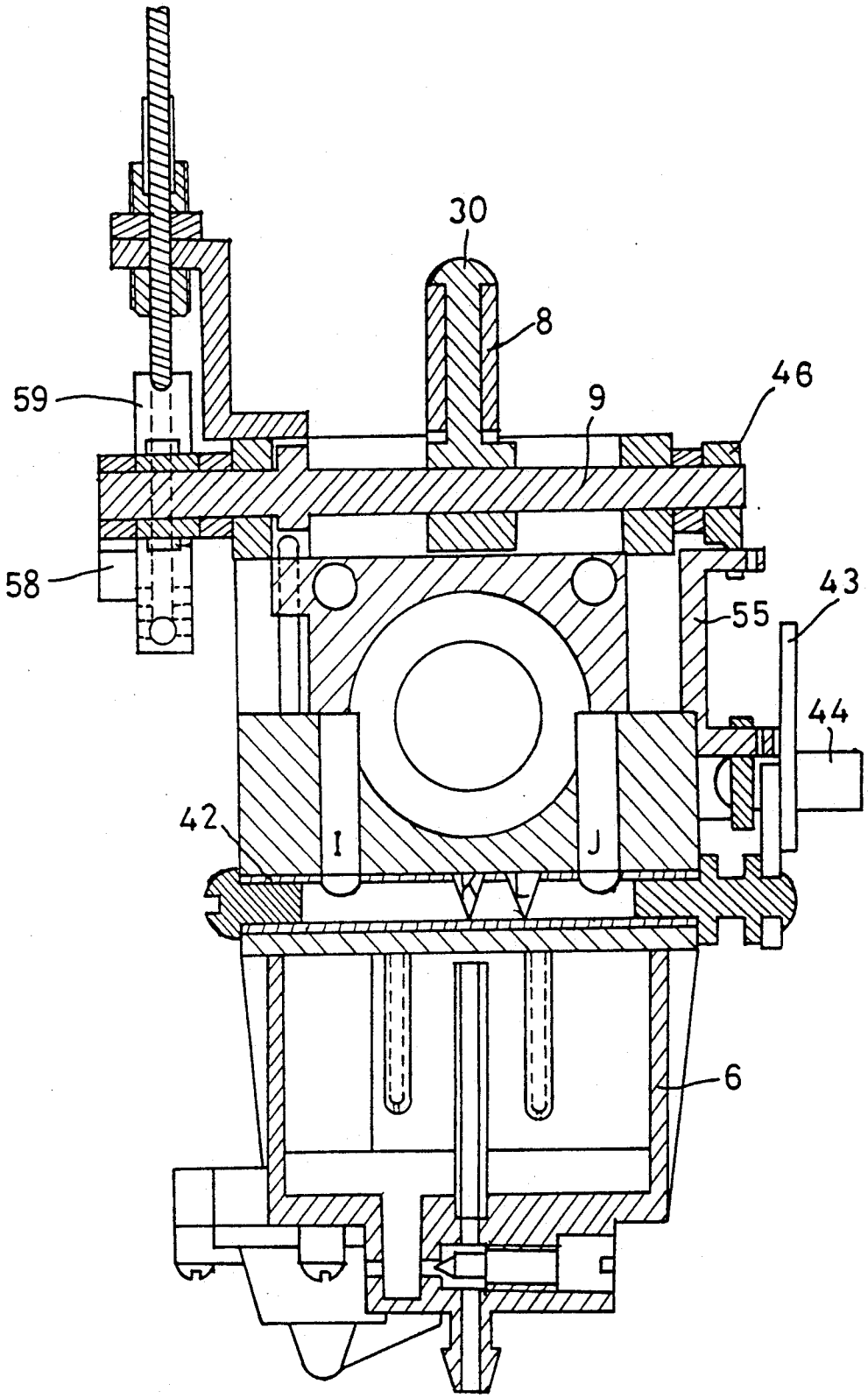

The present invention is provided with an automatic horse-power-regulating choker valve; when a car runs up a sloping road, or otherwise has a heavier engine load, the vacuum condition of the engine will be reduced, and then a tubular choker valve 42 (as shown in FIG. 3-2) will function to close a vent K for the heavy-duty carbureting tube 25, and to close a vent L for the idle fuel carbureting tube 49. Since the intake air usually passing through the idle fuel carbureting tube 49 and the heavy-duty carbureting tube 25 is limited, the density of the atomized fuel will be increased so as to supply sufficient atomized fuel during the instant acceleration for a higher load. One end of the tubular choker 42 is connected with a cam 43, which is then connected with a vacuum motor 45 by means of a connecting rod 47. The cam 43 is in contact with a roller 44 which is then connected with an actuating lever 46 through a connecting rod 55. One point should be pointed out particularly, i.e., when the tubular choker 42 is functioning, the closed position thereof is limited by the curved surface of the cam 43 and roller 44 (as shown in FIG. 3-1); then, the closed position of the tubular choker value 42 is just capable of satisfying the requirement of the engine. If the choker valve is over-opened, more fuel will be consumed without increasing the horsepower output. If the choker valve is under-opened, the horsepower output would also be affected; therefore, the present invention is provided with an automatic horse-power-regulating choker valve which includes a vacuum motor 45, a connecting rod 47, a cam 43, a roller 44, an actuating lever 46, a connecting rod 55 and a tubular choker 42.

As shown in FIG. 1, the lower part of the carburetor according to the present invention has a floating fuel-supply assembly which includes a float chamber 6, a float 7, a needle valve seat 19, a needle valve 20 and a pivot 21. The function of the float fuel-supply assembly is to maintain a given volume of fuel to flow into the float chamber 6 before flowing into other fuel passages. Since the floating fuel-supply assembly is a well-known skill, and is not claimed in the claims of the present invention, no further description is given.

The carburetor (as shown in FIG. 2) further has a vacuum-controlled delay valve for the engine, and the function thereof is to delay the return of the venturi to its original position upon braking or the choker returning so as to reduce fuel supply for reducing waste gas and fuel consumption during the choker valve being released.

When a car runs at a higher speed, an sudden application of the brake or a reduction of speed for an emergency might take place; in that case the vacuum strength of the engine will be increased; if there is no vacuum-controlled delay valve mounted in the engine to delay the venturi to return to its original position, additional fuel would be released to cause more fuel consumption and pollution.

FIG. 2-1 shows a plunging rod or delay lever 32 which delays the return of venturi 4 to its original position. Both the main power transmission member 59 and the head block 58 are pivotably affixed to the axis 9. During acceleration, the main power transmission member 59 rotates the axis 9 and thus the head block 58 in the direction shown in FIG. 2-1, away from the delay lever 32. At this time, the delay lever 32 is pushed to its top position, as shown in FIG. 2. When the accelerator is suddenly released, the head block 58 strikes the delay lever 32, thereby delaying the release of air in the vacuum controlled delay valve, thereby delaying the return of the venturi to its original position. During higher speed, the vacuum created by the engine is also at a higher level, therefore, causing a longer delay in the delaying action. This improves fuel consumption and reduces waste gas generation.

By means of the vacuum-controlled delay valve, the engine would have additional strength to cause additional delay so as to meet the actual requirement of an engine.

The vacuum-controlled delay valve includes mainly a cylinder body 31 and a base 33; further, the valve also includes a plunging rod 32 being coupled with a U-shaped rubber seal 38, which are slid back and forth in the cylinder body 31; there are two O-rings 37 and 41 mounted among the cylinder body 31, the plunging rod 32 and the base 33 for leakproof function. A washer 39 is mounted between one end of the plunging rod 32 and the U-shaped rubber seal 38. An intake hole C is controlled, to open and close, by means of a steel ball 35, a spring 36 and a positioning pin 40. The base 33 has a small exhaust hole D for delay function. The cylinder body 31 has a connector 34 which is to be connected with the vacuum source of an engine.

Figures 2, 4:
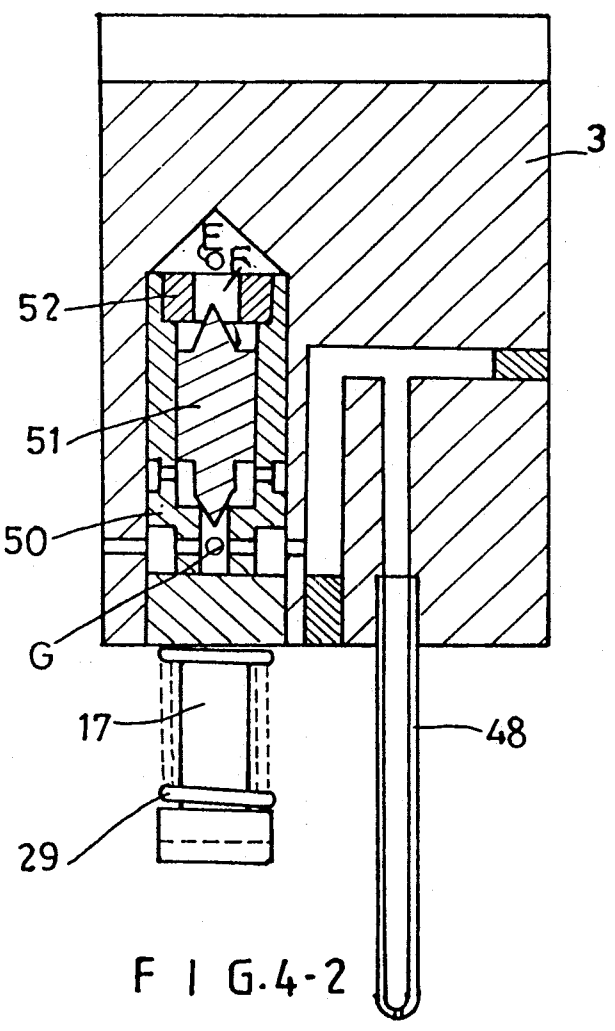
Figures 1, 4:
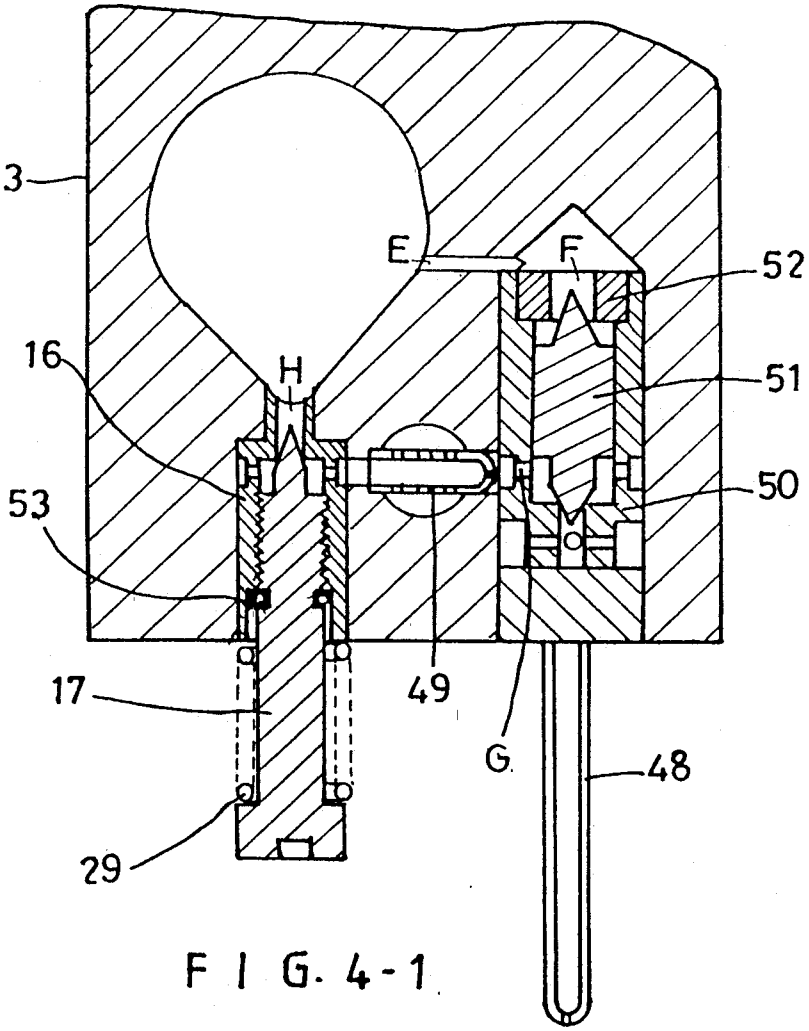

Another feature of the present invention is that an idle fuel passage system as shown in FIGS. 4-1 and 4-2 is furnished in the rear part 3 of the carburetor, and it includes a valve body 50, a fuel needle 51 and an upper cap 52. The aforesaid idle fuel passage system is used for replacing a solenoid type of fuel passage switch, and it has a feature of being small in size and simple in structure. When the engine is started, a fuel will enter through a fuel intake tube 48, and the vacuum force of the engine will, through a hole E, actuate a fuel needle 51 to close a hole F in the upper cap 52; the fuel will flow through a hole G, an idle fuel carbureting tube 49, a hole H, and then flows into the engine. When the engine is stopped, the fuel needle 51 will fall downwards to close the hole G to prevent fuel from flowing out. The idle fuel outlet assembly 16 and an adjusting screw 17 fixedly mounted in the rear seat 3 are used for controlling the idle fuel output. The screw 17 can be adjusted to a given position so as to supply a suitable amount of atomized fuel to an engine for running idly. The screw 17 is mounted with an O-ring and a spring 29, whereby the screw 17 can be maintained in a position without moving so as to have a steady idle running.

The carburetor according to the present invention has an adjustable venturi for saving fuel without sacrificing the good features of a conventional carburetor; since the carburetor is also furnished with an automatic horsepower-regulating choker valve to enable the engine to save fuel and to produce more horsepower. When a car installed with a vacuum-controlled delay valve runs in a heavy city traffic, the fuel consumption and the waste gas pollution would be reduced during braking and releasing the accelerator; such a feature as mentioned above is significant during the environmental protection movement being in vogue. The idle fuel passage system can maintain a steady idle run of an engine to have a complete combustion of fuel so as to reduce the volume of the waste gas exhausted.

The embodiment of the carburetor according to the present invention has been tested primarily; it has been noted that the tests show the HC of waste gas is under 300 PPM, and CO is under 1.5% (from a SAN-YANG motor cycle of 125 CC). A road performance test shows that one liter of fuel can have the motorcycle run over 60 kilometers; the highest speed of the motorcycle can reach over 120 KM/H. It proves that the result tested has reached the design requirements of saving fuel, higher horsepower output and low pollution.

I claim:

1. A carburetor with a cam-controlled venturi to be used in a vehicle to supply appropriate air and fuel mixture to an engine, said carburetor comprises:

(a) a front part, a body and a rear part, said body being fixedly disposed between said front part and said rear part;

(b) a cam-controlled adjustable venturi mechanism, in said front part which is capable of supplying a suitable fuel and air mixture to said engine in a continuously adjustable manner;

(c) a main choker valve in said rear part which is coupled to said adjustable venturi to effectuate coordinated movements in supplying the fuel and air mixture;

(d) a heavy duty supply system for increasing fuel to air ratio during heavy engine load;

(e) a vacuum-controlled delay valve to be actuated by a vacuum effect of said engine for delaying the movement of said venturi during braking conditions to conserve fuel and thereby reducing waste gas generation;

(f) an automatic horsepower-regulating choker valve to be actuated by a vacuum provided by said engine for controlling additional fuel intake into said venturi; and (g) an idle fuel passage system having a vent which is controllable by said automatic horsepower-regulating choker valve.

2. The carburetor with a cam-controlled venturi as claimed in claim 1 wherein said adjustable venturi mechanism comprises:

(a) an adjustable venturi for air intake and two carbureting tubes for fuel intake; said adjustable venturi being connected with a connecting rod and a return spring for adjusting its throat size; said connecting rod being made to move up and down by means of a cam mounted on a pivot; and (b) a fuel outlet being formed by a gap between said front part and said body;

(c) whereby said adjustable venturi being controlled by the curved surface of said cam so as to suck a suitable amount of fuel in accordance with the requirement of an engine.

3. The carburetor with a cam-controlled venturi as claimed in claim 1 wherein (a) said main choker valve being fixedly mounted on said rear part;

(b) said main choker valve being connected with a fuel needle which is mounted in place with a retaining spring, a connecting block and a steel cable;

(c) said connecting block being mounted with a return spring to press against said connecting block and said fuel needle;

(d) a heavy duty carbureting tube having a fuel outlet in cooperation with said fuel needle whereby said fuel needle having a slope so as to fit said fuel outlet of said heavy-duty carbureting tube; whereby during accelerating and/or having a heavy load, said main choker valve being pulled away from said fuel outlet so as to let said heavy-duty carbureting tube supply additional fuel.

4. The carburetor with a cam-controlled venturi as claimed in claim 1 wherein said vacuum-controlled delay valve comprises a cylinder body, a base and a plunging rod; said plunging rod being mounted with a U-shaped rubber seal which can slide back and forth; said base having an intake hole which is to be controlled to open and close by means of a steel ball, a spring and a positioning pin; and said base having a very small exhaust hole to release air slowly thereby providing a delaying function.

5. The carburetor with a cam-controlled venturi as claimed in claim 3 wherein said automatically horsepower-regulating choker valve comprises a tubular choker valve adapted to close a vent in communication with said heavy carbureting tube and an idle fuel carbureting tube when the vacuum of the engine is lowered; one end of said valve being connected with a cam which is connected with a vacuum valve by means of a connecting rod; said cam being mounted with a roller that is connected with a connecting rod by means of a pivot to couple with said cam; and the opening-and-closing position of said tubular choker being controlled and limited by the curved surface of said cam and said roller.

6. The carburetor with a cam-controlled venturi as claimed in claim 3 wherein said idle fuel passage system comprises:

(a) a fuel-intake tube and a valve body;

(b) a fuel needle to be moved up and down in said valve body according to the strength of vacuum;

(c) an upper cap at one end of said valve body, said cap having a hole therein allowing fuel to flow therethrough;

(d) a control valve mounted in said rear part which comprises an idle fuel carbureting tube, an idle fuel outlet assembly, an adjusting screw and a spring;

(e) whereby said fuel flows into said control valve through said fuel intake tube, and engine vacuum capable to cause said fuel needle to close said hole in said upper cap to enable fuel to flow through a hole in the lower end of said valve body, and through said idle fuel carbureting tube, and a hole to enter engine; said idle fuel outlet assembly being fixedly mounted in said rear part and having a screw mounted through a spring, and said screw able to be adjusted to supply a suitable amount of fuel gas for an idle running speed.

* * * * *